US007411565B2

(12) United States Patent
McKinzie, III et al.

(10) Patent No.: US 7,411,565 B2
(45) Date of Patent: Aug. 12, 2008

(54) ARTIFICIAL MAGNETIC CONDUCTOR SURFACES LOADED WITH FERRITE-BASED ARTIFICIAL MAGNETIC MATERIALS

(75) Inventors: William E. McKinzie, III, Fulton, MD (US); Rodolfo E. Diaz, Phoenix, AZ (US); Victor C. Sanchez, Laurel, MD (US); Eric Caswell, Severn, MD (US)

(73) Assignee: Titan Systems Corporation/Aerospace Electronic Division, Greenbelt, MO (US)

( * ) Notice: Subject to any disclaimer, the term of this patent is extended or adjusted under 35 U.S.C. 154(b) by 329 days.

(21) Appl. No.: 10/868,382

(22) Filed: Jun. 15, 2004

(65) Prior Publication Data

US 2005/0030137 A1 Feb. 10, 2005

Related U.S. Application Data

(60) Provisional application No. 60/480,098, filed on Jun. 20, 2003.

(51) Int. Cl.
*H01Q 1/38* (2006.01)

(52) U.S. Cl. ..... 343/909

(58) Field of Classification Search ..... 343/700 MS, 343/909

See application file for complete search history.

(56) References Cited

U.S. PATENT DOCUMENTS

| | | | | |
|---|---|---|---|---|
| 4,367,474 | A | 1/1983 | Schaubert et al. | |
| 5,872,534 | A | 2/1999 | Mayer | |
| 6,147,572 | A | 11/2000 | Kaminski et al. | |
| 6,175,337 | B1 | 1/2001 | Jasper, Jr. et al. | |
| 6,483,481 | B1 | 11/2002 | Sievenpiper et al. | |
| 6,512,494 | B1 * | 1/2003 | Diaz et al. | 343/909 |
| 6,670,932 | B1 | 12/2003 | Diaz et al. | |
| 2003/0112186 | A1 | 6/2003 | Sanchez et al. | |

FOREIGN PATENT DOCUMENTS

| | | |
|---|---|---|
| WO | WO 99/50929 | 10/1999 |
| WO | WO 01/24313 A1 | 4/2001 |
| WO | WO 01/73892 A2 | 10/2001 |

OTHER PUBLICATIONS

R. J. King and K.S. Park, "Synthesis of surface reactances using grounded pin bed structure," *Electronics Letters*, vol. 17, 1981, pp. 52-53.

(Continued)

*Primary Examiner*—Michael C Wimer
(74) *Attorney, Agent, or Firm*—Brinks Hofer Gilson & Lione

(57) ABSTRACT

A magnetically-loaded artificial magnetic conductor surface provides enhanced bandwidth. The structure includes in one embodiment a thumbtack structure with a spacer layer that is loaded with a barium-cobalt hexaferrite based artificial magnetic material. Specifically, the geometry consists of a ground plane covered with thinly sliced ferrite tiles that are metallized and stacked. Each tile has a metal via running through its center that is electrically connected to the plated metallized surfaces. A foam spacer layer resides above the ferrite tiles. Atop the foam spacer layer rests a capacitive surface, which can be realized as a single layer array of metal patches, a multiple layer array of overlapping patches or other planar capacitive geometry.

7 Claims, 8 Drawing Sheets

600

OTHER PUBLICATIONS

Ray. J. King, David. V. Theil, and Kwang S. Park, "The synthesis of surface reactance using an artificial dielectric," *IEEE Trans. Antennas and Propagation*, vol. AP-31, No. 3, May 1983, pp. 471-476.

R. M. Walser et al., "New smart materials for adaptive microwave signature control," *Proceedings of the Society of Photo-Optical Instrumentation Engineers* (*SPIE*), vol. 1916, 1993, pp. 128-134.

Daniel F. Sievenpiper, "High-impedance electromagnetic surfaces," Ph.D. dissertation, UCLA electrical engineering department, submitted Jan. 1999, 161 pages.

D. Sievenpiper, L. Zhang, and E. Yablonovitch, "High-impedance electromagnetic ground planes," *IEEE Intl. MTT-S Symp*., Jun. 13-19, 1999, 4 pages.

D. Sievenpiper, R. Broas, and E. Yablonovitch, "Antennas on high-impedance ground planes," *IEEE Intl. MT-S Symp*., Jun. 13-19, 1999, 4 pages.

L. Zhang, N. G. Alexopoulos, D. Sievenpiper, and E. Yablonovitch, "An efficient finite-element method for the analysis of photonic bandgap materials," *IEEE Intl. MTT-S Symp*., Jun. 13-19, 1999, 4 pages.

Dan Sievenpiper, Lijun Zhang, Romulo F. Jimenez Broas, Nicolas G. Alexopoulos, and Eli Yablonovitch, "High-impedance electromagnetic surfaces with a forbidden frequency band," *IEEE Trans. Microwave Theory and Techniques*, vol. 47, No. 11, Nov. 1999, pp. 2059-2074.

Ruey Bing Hwang and Song Tsuen Peng, "Guidance Characteristics of Two-Dimensionally Periodic Impedance Surface", *IEEE Trans. Microwave Theory and Techniques*, vol. 47, No. 12, Dec. 1999, pp. 2503-2511.

Rodolfo E. Diaz, James T. Aberle, and William E. McKinzie III, "TM mode analysis of a Sievenpiper high-impedance reactive surface," *IEEE Intl. Antennas and Propagation Symp*., Jul. 16-21, 2000, Salt Lake City, Utah, pp. 1-21.

M. Rahman and M. A. Stuchly, "Equivalent circuit model of 2D microwave photonic bandgap structures," *URSI National Radio Science Meeting*, Jul. 16-21, 2000, Salt Lake City, Utah, p. 322.

G. Poilasne and E. Yablonovitch, "Matching antennas over high-impedance ground planes," *URSI National Radio Science Meeting*, Jul. 16-21, 2000, Salt Lake City, Utah, p. 312.

H. Y. D. Yang, R. Kim and D. R. Jackson, "Surface-Wave Band Gaps and Leaky Modes On Integrated Circuit Structures With Planer Periodic Metallic Elements", IEEE MTT-S Digest, Copyright 2000, pp. 1521-1524.

R. B. Hwang, S. T. Peng and C. C. Chen, "Surface-Wave Suppression of Resonance-Type Periodic Structures", IEEE MTT-S Digest, Copyright 2000, pp. 1525-1528.

R. J. King and S. W. Cho, "Surface Impedance Planes", Dept. of Electrical and Computer Engineering, University of Wisconsin, Copyright 2000, 16 pages.

Keisuke Kageyama et al., "Tunable Active Filters Having Multilayer Structure Using LTCC", IEEE, Copyright 2001, 4 pages.

Ben A. Munk, "*Frequency Selective Surfaces, Theory and Design*," John Wiley and Sons, New York, Copyright 2000, pp. 26-62 and 279-314.

John C. Vardaxoglou, "*Frequency Selective Surfaces: Analysis and Design*," Research Studies Press Ltd, Copyright 1997, pp. 1-9, 18-73, 116-152 and 221-273.

* cited by examiner

- PRIOR ART -

- PRIOR ART -

- PRIOR ART -

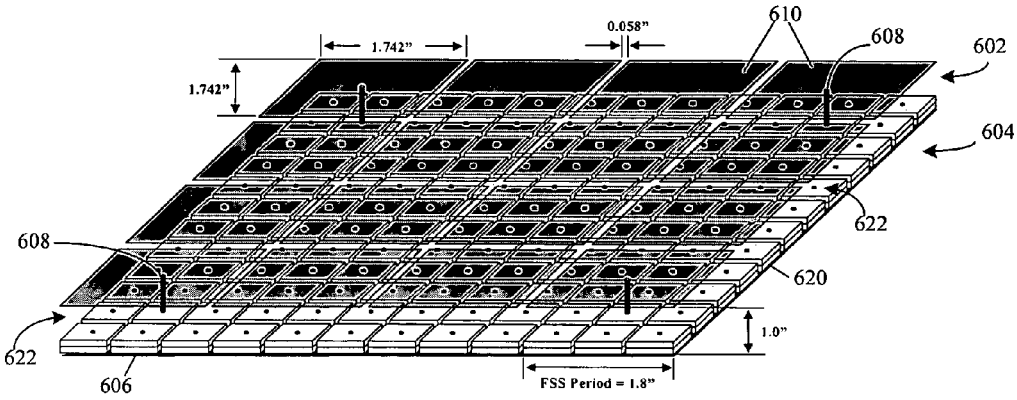
600 FIG. 6
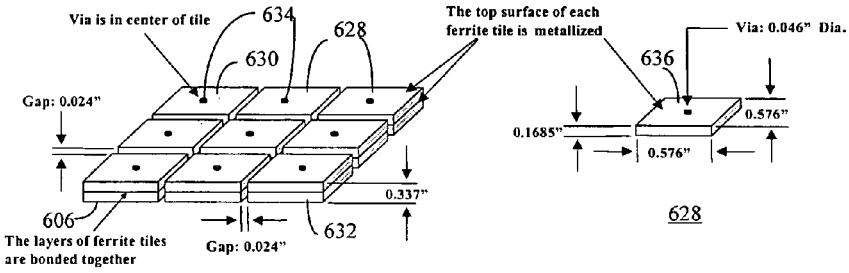
FIG. 7

ARTIFICIAL MAGNETIC CONDUCTOR SURFACES LOADED WITH FERRITE-BASED ARTIFICIAL MAGNETIC MATERIALS

CROSS REFERENCE TO RELATED APPLICATION

The present patent document claims the benefit of the filing date under 35 U.S.C. §119(e) of Provisional U.S. Patent Application Ser. No. 60/480,098, filed Jun. 20, 2003, which is hereby incorporated by reference.

FEDERALLY SPONSORED RESEARCH OR DEVELOPMENT

A portion of the disclosure herein was developed under DARPA contract number F19628-99-C-0080.

BACKGROUND

The present invention relates generally to high impedance surfaces. More particularly, the present invention relates to artificial magnetic conductor surfaces loaded with ferrite-based artificial magnetic materials.

A high impedance surface is a lossless, reactive surface whose equivalent surface impedance, $$Z_s = \frac{E_{\tan}}{H_{\tan}},$$

approximates an open circuit and which inhibits the flow of equivalent tangential electric surface current, thereby approximating a zero tangential magnetic field, $H_{tan} \approx 0$. $E_{tan}$ and $H_{tan}$ are the electric and magnetic fields, respectively, tangential to the surface. High impedance surfaces have been used in various antenna applications. These applications range from corrugated horns which are specially designed to offer equal electric (E) and magnetic (H) plane half power beamwidths to traveling wave antennas in planar or cylindrical form. However, in these applications, the corrugations or troughs are made of metal where the depth of the corrugations is one quarter of a free space wavelength, $\lambda/4$, where $\lambda$ is the wavelength at the frequency of interest. At high microwave frequencies, $\lambda/4$ is a small dimension, but at ultra-high frequencies (UHF, 300 MHz to 1 GHz), or even at low microwave frequencies (1-3 GHz), $\lambda/4$ can be quite large. For antenna applications in these frequency ranges, an electrically-thin ($\lambda/100$ to $\lambda/50$ thick) and physically thin high impedance surface is desired.

One example of a thin high-impedance surface is disclosed in D. Sievenpiper, "High-impedance electromagnetic surfaces," Ph.D. dissertation, UCLA electrical engineering department, filed January 1999, and in PCT Patent Application number PCT/US99/06884. FIG. 1 shows an example of such a high impedance surface 100. The high-impedance surface 100 includes a low permittivity spacer layer 104 and a capacitive frequency selective surface (FSS) 102 formed on a metal backplane 106. Metal vias 108 extend through the spacer layer 104, and connect the metal backplane to the metal patches of the FSS layer, creating what may be termed a thumbtack structure. The thickness h of the high impedance surface 100 is much less than $\lambda/4$ at resonance, and typically on the order of $\lambda/50$, as indicated in FIG. 1.

The FSS 102 of the prior art high impedance surface 100 is a periodic array of metal patches 110 which are edge coupled to form an effective sheet capacitance. This is referred to as a capacitive frequency selective surface (FSS). Each metal patch 110 defines a unit cell which extends through the thickness of the high impedance surface 100. Each patch 110 is connected to the metal backplane 106, which forms a ground plane, by means of a metal via 108, which can be plated-through holes. The periodic array of metal vias 108 has been known in the prior art as a rodded media, so these vias are sometimes referred to as rods or posts. The spacer layer 104 through which the vias 108 pass is a relatively low permittivity dielectric typical of many printed circuit board substrates. The spacer layer 104 is the region occupied by the vias 108 and the low permittivity dielectric. The spacer layer is typically 10 to 100 times thicker than the FSS layer 102. Also, the dimensions of a unit cell in the prior art high-impedance surface are much smaller than $\lambda$ at the fundamental resonance. The period is typically between $\lambda/40$ and $\lambda/12$. This configuration of metal patches 110 and metal vias 108 may be referred to as a thumbtack structure.

A frequency selective surface (FSS) is a two-dimensional array of periodically arranged elements which may be etched on, or embedded within, one or multiple layers of dielectric laminates. Such elements may be either conductive dipoles, patches, loops, or even slots. As a thin periodic structure, an FSS is often referred to as a periodic surface.

Frequency selective surfaces have historically found applications in out-of-band radar cross section reduction for antennas on military airborne and naval platforms. Frequency selective surfaces are also used as dichroic subreflectors in dual-band Cassegrain reflector antenna systems. In this application, the subreflector is transparent at frequency band $f_1$ and opaque or reflective at frequency band $f_2$. This allows placement of a feed horn for band $f_1$ at the focal point for the main reflector, and another feed horn operating at $f_2$ at the Cassegrain focal point. In this manner, a significant weight and volume savings can be achieved over using two conventional reflector antennas. Such savings is critical for space-based platforms.

The prior art high-impedance surface 100 provides many advantages over corrugated metal structures. The surface is constructed with relatively inexpensive printed circuit technology and can be made much lighter than a corrugated metal waveguide, which is typically machined from a block of aluminum. In printed circuit form, the prior art high-impedance surface can be 10 to 100 times less expensive for the same frequency of operation. Furthermore, the prior art surface offers a high surface impedance for both x and y components of tangential electric field, which is not possible with a corrugated waveguide. Corrugated waveguides offer high surface impedance for one polarization of electric field only. According to the coordinate convention used herein, a surface lies in the x-y plane and the z-axis is normal or perpendicular to the surface. Further, the prior art high-impedance surface provides a substantial advantage in its height reduction over a corrugated metal waveguide, and may be less than one-tenth the thickness of an air-filled corrugated metal waveguide.

A high-impedance surface is important because it offers a boundary condition which permits wire antennas conducting electric currents to be well-matched and to radiate efficiently when the wires are placed in very close proximity to this surface (e.g., less than $\lambda/100$ away). The opposite is true if the same wire antenna is placed very close to a metal or perfect electric conductor (PEC) surface. The wire antenna/PEC surface combination will not radiate efficiently due to a very severe impedance mismatch. The radiation pattern from the antenna on a high-impedance surface is confined to the upper half space, and the performance is unaffected even if the high-impedance surface is placed on top of another metal surface. Accordingly, an electrically-thin, efficient antenna is very appealing for countless wireless devices and skin-embedded antenna applications.

Another example of a high impedance surface is disclosed in U.S. Pat. No. 6,512,494 B1, issued to Diaz, et al. on Jan. 28, 2003. This reference discloses an artificial magnetic conductor which is resonant at multiple resonance frequencies. The artificial magnetic conductor is characterized by an effective media model which includes a first layer and a second layer. Each layer has a layer tensor permittivity and a layer tensor permeability having non-zero elements on the main tensor diagonal only. U.S. Pat. No. 6,512,494 B1 is incorporated herein in its entirety by this reference. The disclosed AMC is a two-layer, periodic, magnetodielectric structure where each layer is engineered to have a specific tensor permittivity and permeability behavior with frequency. This structure has the properties of an artificial magnetic conductor over a limited frequency band or bands, whereby, near its resonant frequency, the reflection amplitude is near unity and the reflection phase at the surface lies between +/−90 degrees. This engineered material also offers suppression of transverse electric (TE) and transverse magnetic (TM) mode surface waves over a band of frequencies near where it operates as a high impedance surface.

FIG. 2 is a photograph of a prior art artificial magnetic conductor 200. The AMC 200 is embodied with a thick foam core spacer layer 204 and an array of metal patches 210 with metal vias 208 extending from some of the metal patches 210 through the spacer layer 204. The AMC 200 was developed under DARPA Contract Number F19628-99-C-0080. The size of the AMC 200 is 10 in. by 16. in by 1.26 in thick (25.4 cm×40.64 cm×3.20 cm). The weight of the AMC is 3 lbs., 2 oz. The 1.20 inch (3.05 cm) thick, low permittivity spacer layer is realized using foam. The FSS has a period of 298 mils (7.57 mm), and a sheet capacitance of 0.53 pF/sq.

FIG. 3 shows the measured reflection coefficient phase referenced to the top surface of the AMC 200 as a function of frequency. A ±90° phase bandwidth of 900 MHz to 1550 MHz is observed. Three curves are traced on the graph, each representing a different density of vias within the spacer layer (one out of every two possible vias is installed, curve AMC 1-2, one out of every four is installed, curve AMC 1-4, and one out of every 18 vias is installed, curve AMC 1-18). As expected from the effective media model described in U.S. Pat. No. 6,512,494 B1, the density of vias does not have a strong effect on the reflection coefficient phase.

Test set-ups are used to experimentally verify the existence of a surface wave bandgap in an AMC. In each case, the transmission response ($S_{21}$) is measured between two Vivaldi-notch radiators that are mounted so as to excite the dominant electric field polarization for TE and TM modes on the AMC surface. For the TE set-up, the antennas are oriented horizontally. For the TM set-up, the antennas are oriented vertically. Absorber is placed around the surface-under-test to minimize the space wave coupling between the antennas. The optimal configuration—defined empirically as "that which gives us the smoothest, least-noisy response and cleanest surface wave cutoff"—is obtained by trial and error. The optimal configuration is obtained by varying the location of the antennas, the placement of the absorber, the height of absorber above the surface-under-test, the thickness of absorber, and by placing a conducting foil wall between layers of absorber.

FIG. 4 illustrates the measured $S_{21}$ for both transverse electric (TE) and transverse magnetic (TM) configurations for the AMC 200 of FIG. 2. As can be seen, a sharp TM mode cutoff occurs near 950 MHz, and a gradual TE mode onset occurs near 1550 MHz. This bandgap is correlated closely to the +/−90-degree reflection phase bandwidth of the AMC.

Broadband antennas such as spirals can be mounted over the thick foam core AMC 200 of FIG. 2. FIG. 5 shows a spiral antenna on the thick foam AMC core of FIG. 2. Such antennas exhibit good impedance and gain performance over the range of frequencies where both a +/−90-degree reflection phase occurs, for normal incidence, as well as where a surface wave bandgap (where both TM and TE modes are cutoff) is found.

In most wireless communications applications, it is desirable to make the antenna ground plane as small and light weight as possible so that it may be readily integrated into physically small, light weight platforms. The relationship between the instantaneous bandwidth of an AMC such as the AMC 200 of FIG. 2 and its thickness is given by the following equation:

$$\frac{BW}{f_0} = 2\pi\mu_r \frac{h}{\lambda_0}.$$

Here, h is the thickness of the spacer layer, $\lambda_0$ is the free space wavelength at resonance where a zero degree reflection is observed and $\mu_r$ is the magnetic permeability of the spacer layer. As can be seen from this equation, to support a wide instantaneous bandwidth BW. the AMC thickness $\lambda_0$ must be relatively large or the permeability must be high $\mu_r$. For example, to accommodate an octave frequency range ($BW/f_0$=0.667), the AMC thickness must be at least 0.106 $\lambda_0$, corresponding to a physical thickness of 1.4 inches (3.56 cm) at a center frequency of 900 MHz. This thickness is too large for many practical applications. As noted, the antenna ground plane should be as small and light weight as possible.

Accordingly, there is a need for an improved artificial magnetic conductor with enhanced bandwidth offering reduced size and weight.

BRIEF SUMMARY

By way of introduction only, a new realization of an artificial magnetic conductor surface with enhanced bandwidth is disclosed. In one embodiment, the artificial magnetic conductor has the typical thumbtack structure with a spacer layer that is loaded with a magnetic material (one with permeability >1), such as barium-cobalt hexaferrite based artificial magnetic material. In one specific embodiment, the geometry consists of a ground plane covered with thinly sliced ferrite tiles that are metallized and stacked. Each tile has a metal via such as a plated through hole extending through its center that is electrically connected to the plated metallized surface. A foam spacer layer resides above the ferrite tiles. Atop the foam spacer layer rests a capacitive surface, which can be realized as a single layer array of metal patches, a multiple layer array of overlapping patches or other planar capacitive geometry. The periodicity of the metal patches in the capacitive FSS may be different from the periodicity of the ferrite tiles. Typically, an integral multiple of ferrite tiles will reside within the same footprint as a single capacitive patch. Metal vias connect the center of the capacitive patches to ground. Here again, the periodicity of the capacitive patch array vias will generally be different than that of the ferrite tile array vias, but typically an integral number of ferrite vias will correspond to each via in the patch array. When carefully designed, the above structure will result in a surface wave bandgap that corresponds with the high impedance frequency band. Also, this frequency band will be greater than that of a conventional AMC having a thumbtack structure of the same physical thickness.

The foregoing summary has been provided only by way of introduction. Nothing in this section should be taken as a limitation on the following claims, which define the scope of the invention.

BRIEF DESCRIPTION OF THE DRAWINGS

FIG. 6 is a isometric view showing geometry and structure of an exemplary magnetically loaded artificial conductor;

FIG. 7 is a detail view of a portion of the magnetically loaded artificial magnetic conductor of FIG. 6;

DETAILED DESCRIPTION OF THE PRESENTLY PREFERRED EMBODIMENTS

Figure 1:
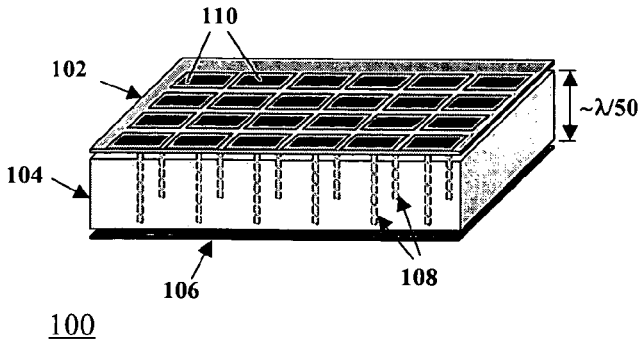
FIG. 1 is a perspective view of a prior high impedance surface.
Figure 2:
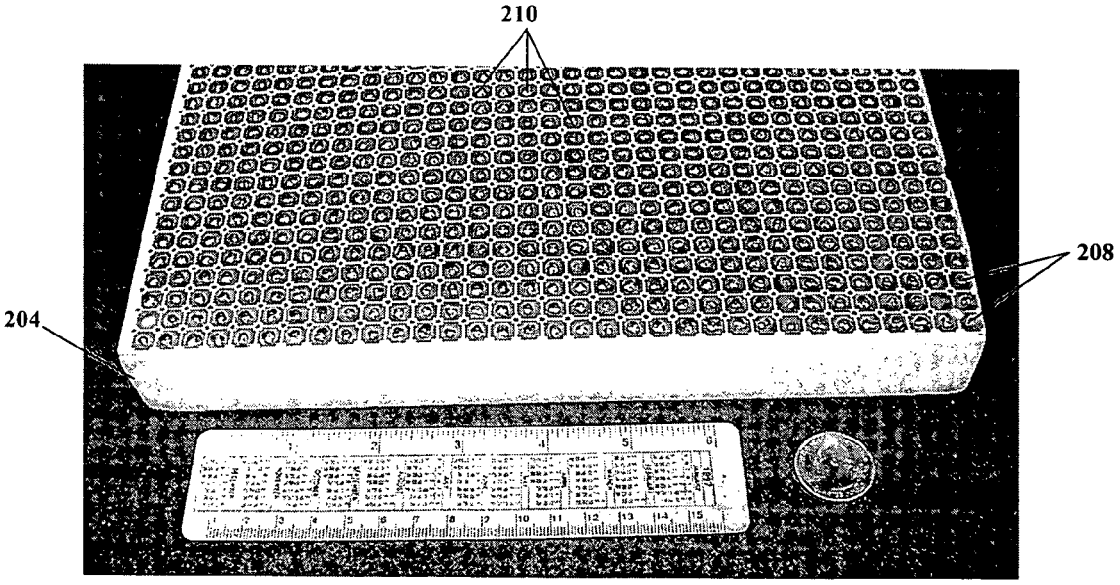
FIG. 2 is a photograph of a prior art artificial magnetic conductor.
Figure 3:
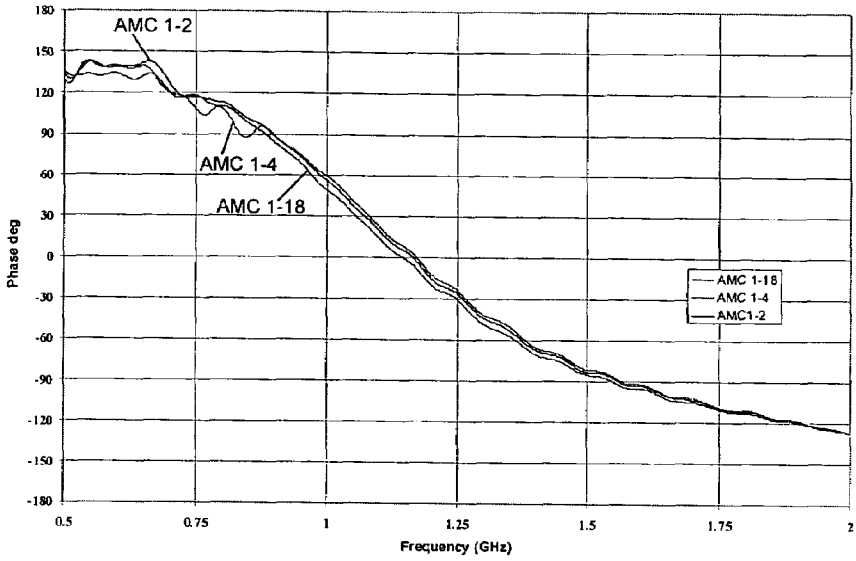
FIG. 3 illustrates measured reflection coefficient phase versus frequency for the artificial magnetic conductor of FIG. 2.
Figure 4:
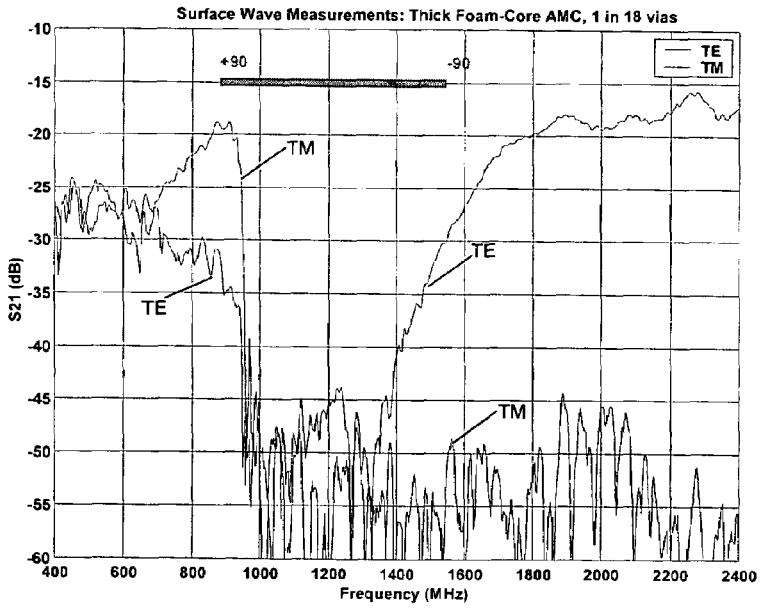
FIG. 4 illustrates the measured $S_{21}$ for both transverse electric (TE) and transverse magnetic (TM) configurations for the artificial magnetic conductor of FIG. 2.
Figure 5:
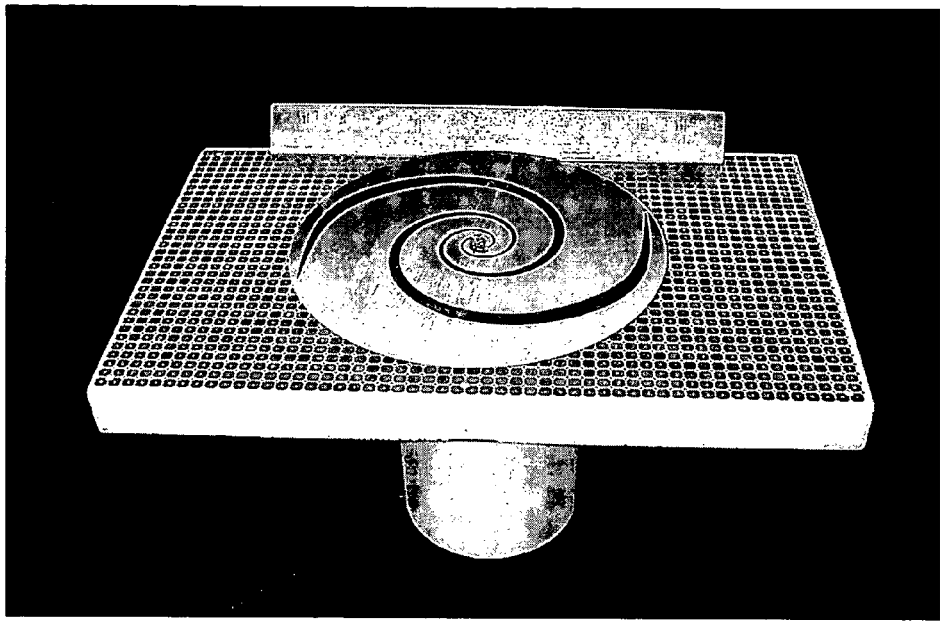
FIG. 5 is a photograph of a prior art spiral antenna on the thick foam core artificial magnetic conductor of FIG. 2.

FIGS. 6 and 7 illustrate one exemplary embodiment of a magnetically loaded artificial conductor 600. The magnetically loaded AMC 600 is a variation of the Sievenpiper thumbtack structure described above in conjunction with FIG. 1. The magnetically loaded AMC 600 makes use of a low-loss, aligned, barium-cobalt hexaferrite material in the spacer layer. It was designed to operate with a band-center at 315 MHz and 2:1 instantaneous bandwidth in a 1 in (2.54 cm) thick form factor. A drawing with dimensions of the AMC is shown in FIG. 6 and a detailed view of the magnetic material geometry is shown in FIG. 7. For clarity of illustration, not all layers of the AMC are shown in the drawing. The dimensions shown in FIGS. 6 and 7 are exemplary only.

The magnetically loaded artificial magnetic conductor (AMC) 600 includes a relatively low permittivity spacer layer 604 and a capacitive frequency selective surface (FSS) 602 formed on a metal backplane 606. The spacer layer 604 is loaded with a ferrite material 620, illustrated in greater detail in FIG. 7. A dielectric material 622 separates the ferrite material 620 from the FSS 602. In one embodiment, the dielectric material 622 is formed of a dielectric foam such as that sold under the brand name Rohacell.

The FSS 602 includes an array of conductive patches 610 on a first or upper side of the magnetically loaded AMC 600. Metal vias 608 extend through the spacer layer and connect the metal backplane 606 to the metal patches 610 of the FSS layer. In the illustrated example, there is not a one-to-one correspondence between vias 608 and patches 610. Every third patch 610 has a via to the backplane 606. Other ratios may be used as well.

FIG. 7 shows the ferrite material 620 in detail. The ferrite material 620 in this embodiment includes a first layer 630 and a second layer 632 of ferrite tiles 628. The tiles 628 are formed of a barium-cobalt hexaferrite based magnetic material. A via 634 extends through the center of each tile 628. The via 634 is electrically connected to the conductive backplane 606. The top surface 636 of each tile 628 in both the first layer 630 and the second layer 632 is metallized. The layers 630, 632 of tiles 628 are bonded together with a suitable adhesive material.

Any magnetic material can be used for the spacer-layer, including elastomers loaded with iron nanoparticles and several different family types of ferrites. However, the most-appropriate family of ferrites for this problem is the Cobalt Z-types because they have the highest ferrimagnetic resonance frequency—which will result in the lowest magnetic loss at the microwave frequencies of interest. According to Smit and Wijn, Ferrites, John Wiley and Sons, New York, 1959, Chapter XIV, section 51, a polycrystalline sample of the barium-cobalt hexaferrite ($Ba_3Co_2Fe_{24}O_{41}$ or $CO_2Z$) has initial relative permeabilities of the order of 11 and a resonant frequency of the order of 1.5 GHz, while plane crystal-aligned samples (using a rotating magnetic field during pressing) have initial relative permeabilities of the order of 27 with a resonant frequency of the order of 1.2 GHz.

Realization of this ferrite involves complicated material processing techniques. To begin with, ceramic processing and compositional factors should be focused on crystallite size/perfection, and on grain boundary chemistry. Rate calcinations steps reducing time at peak temperature helps reduce crystallite agglomeration factors critical to magnetic alignment and dispersion characteristics. Grain boundary chemistry can be influenced by dopants after the calcinations process to promote densification, retard grain growth, and form a lower loss grain boundary area.

The basic composition for the Smit & Wijn $BA_3Co_2Fe_{24}O_{41}$ consists of:

3 Moles BA $Co_3$

2 Moles Co $Co_3$ (or Cobalt Oxide)

11.76 Moles $Fe_2O_3$ (2% Iron Deficient)

Formulas should be "normalized" for raw material purity/assay values for each raw material used, targeting the molecular values.

Specific Process Description

"Red" mix the raw materials as uniformly as possible. (Darvan "C" can help particle dispersion) a de-ionized (D.I.) water liquid volume of 1.2 cc per gram of formula, worked well to minimize particle settling factors in the drying process. One exemplary embodiment used stainless steel attritor mixing.

Dry and granulate the mix through an 18 mesh or finer stainless steel screen. Rate calcine at 2° C. per minute, room temperature to 1230° C. (10 hours), Soak time ½ hours at 1230° C. A very short time at highest temperature reduces discontinuous particle/crystallite agglomeration factors. Less iron pick up in milling is important to control dielectric losses in the ferrite. A higher calcine temperature may be required for the $Co_2Z$ system.

"Black" mill the calcined (now magnetic) particles to fine, 1 micron or less in size. After calcinations, cycle add $SiO_2$, Mn $Co_3$, and $CaCo_3$ dopants to promote densification and contribute to low dielectric loss characteristics.

High density and controlled crystallite growth are desirable for high permeability. The following dopants are suggested, added as a weight % to the calcined product in the "black" milling process:

Mn $Co_3$→0.5 wt %

Si $O_2$→0.2 wt %

Ca $Co_3$→0.9 wt %

A de-ionized water liquid volume of 1.2 cc per gram of calcined formula with a Darvan "C" additive to help particle dispersion works well. Aggressive attritor milling at 350 RPM for 4 hours using stainless steel media produces a sintered ceramic high density and low loss. Actual iron pick-up needs to be established for the raw materials, process cycles, and grinding equipment used.

Wet pressing the milled product in the presence of an aligning magnetic field can greatly improve magnetic characteristics such as magnetic permeability as shown in the Smit and Wijn book.

Firing the pressed ceramic magnet to high density using again a rate controlled sintering cycle is recommended. Several variations can be tried using 1 block per firing cycle.

Sintering Cycles Suggested

RT→1260° C. 2° C./min (10½ hrs) ½ hr soak at 1260°

RT→1230° C. 2° C./min (10¼ hrs) ½ hr soak at 1230°

RT→1200° C. 2° C./min (10 hrs) ½ hr soak at 1200°

Figure 12:
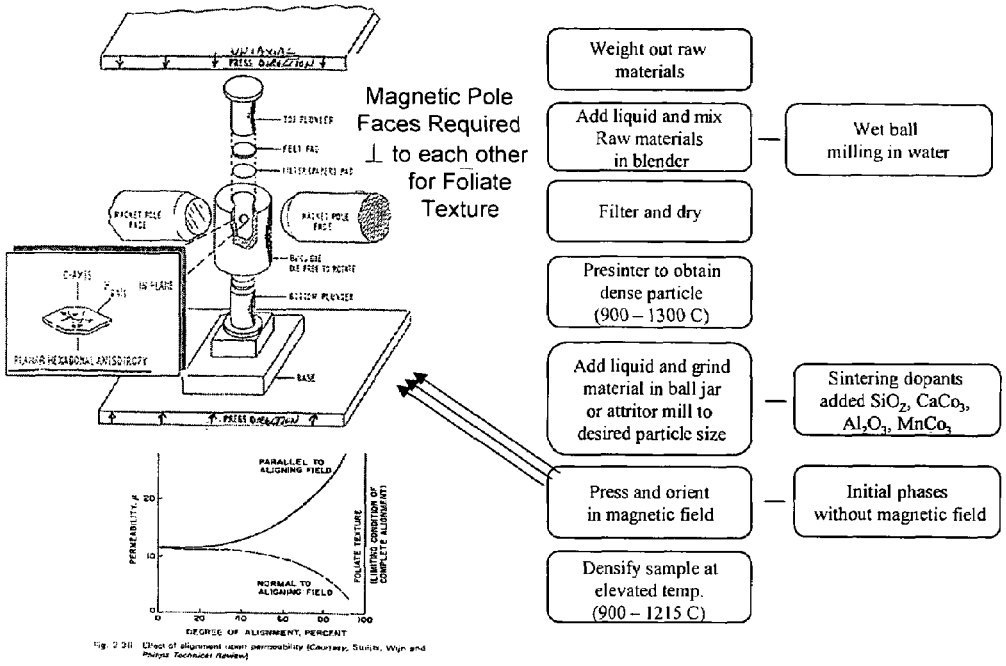
FIG. 12 illustrates an aligned $Co_2Z$ processing technique.

The process for creating aligned $Co_2Z$ is summarized in FIG. 12. The figure also shows a notional drawing of the magnetic alignment press, which creates high magnetic permeability in the plane of alignment (horizontal plane in the figure) and low permeability in the direction normal to this plane (vertical direction in the figure).

Various permutations on the basic $Co_2Z$ composition were investigated with varying specific alignment processes as described below.

Three slurry samples of $Co_2Z$ type ferrite were prepared and pressed in the rotational die with three different pressings and magnetic field conditions. All samples were pressed at 800 psi. on the vertical ram. Condition one was to bring the magnetic field slowly to 1000 gauss with the die rotating at 6 rpm with a pressing time of 4 minutes (constant field the full press time). Condition two was bringing the field to 6000 gauss slowly and rotating the die at 6 rpm. The field was then turned off and on every 60 degrees during the complete pressing cycle. Condition three was to bring the field slowly to 6000 gauss rotating the die at 72 rpm. The field was left on during the complete pressing cycle.

Eight round $Co_2Z$ phase permutation disk samples were sintered and pressed under the following conditions:

Block 1. 4B-AL—no soak, 6000 gauss at 72 rpm, continuous field with a sintered diameter of 2.280 in. (indicating the best radial orientation) I should note that all of the parts sintered to a round state indicating radial orientation.

Block 2. 4B-AL—no soak, 6000 gauss at 6 rpm, field on-off every 60 deg. With a finished diameter of 2.183 in.

Block 3. 4B-AL—no soak, annealed—1000 gauss—6 rpm. Continuous with a finished diameter of 2.191 in. (annealed meaning the slurry was milled, dried and annealed at 900 deg C. for one hour and re-milled with additives for 2 hours). The slurry from 1 thru 6 had an average particle diameter of 0.60 microns. The annealed average particle diameter was 0.70 microns.

Block 4. 4B-AL—6000 gauss—72 rpm. Continuous field with a finished diameter of 2.280 in. The density of this sample was 5.18 gm/cc. Theoretical density max is 5.35 G/CC. The best achieved in phase 3 was 4.88 gm/cc. (this is extremely encouraging) The number 4, 5 and 8 samples were produced from 4BAL slurry from phase 3. Calcination time and temperature of 3 hrs at 2260 deg F.

Block 5. 4B-AL—1000 gauss—6 rpm rotation, constant field with a finished sintered diameter of 2.261 in.

Block 6. 4B-AL—no soak—annealed—6000 gauss field on-off every 60 deg with a finished diameter of 2.2 in. We could not make a sample at 72 rpm for a lack of slurry.

Block 7. 4B-AL—no soak, this means the material prepared in phase 4 has a calcinations time and temperature of 10 min. at 2260 F—10000 gauss—6 rpm rotation, constant field with a sintered diameter of 2.154.

Block 8. 4B-AL—6000 gauss—6 rpm, field on-off every 60 degrees with a finished sintered diameter of 2.261 in.

Figure 13:
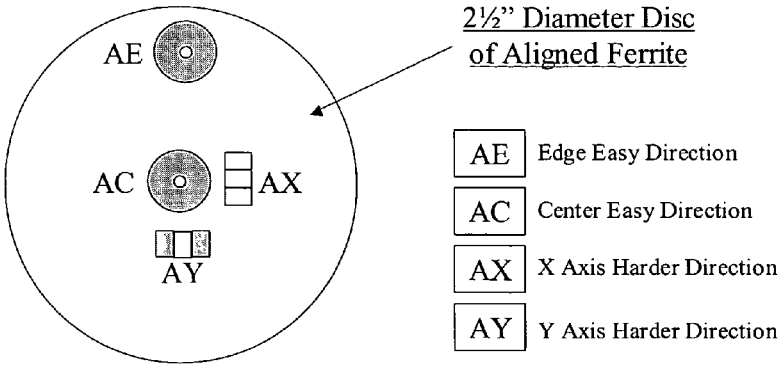
FIG. 13 illustrates toroids cut from an aligned disk for in- and out-of plane permeability testing.

Evaluations included 4 toroids for material parameter tests for each ceramic block as shown in FIG. 13.

Figure 14:
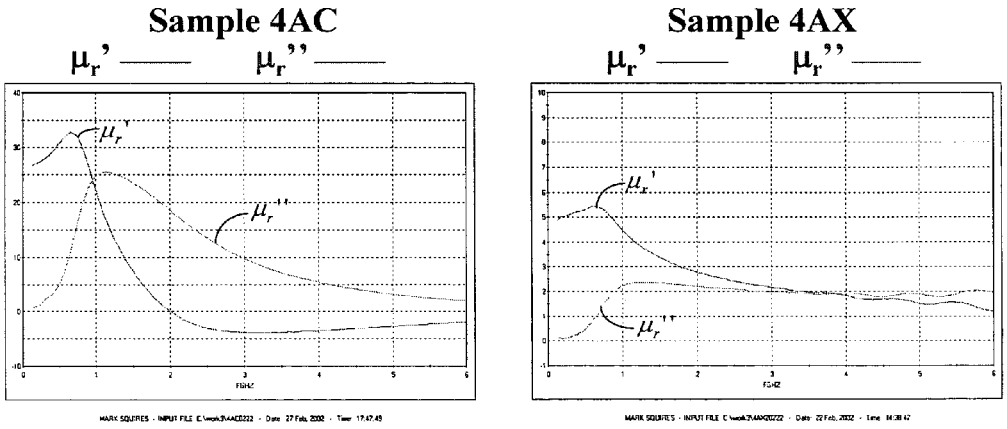
FIG. 14 illustrates measured real and imaginary parts of permeability for block 4 material according to the example of FIG. 13.

The easy axis toroids (AC and AE) and the hard axis toroids (AX and AY) from all 8 block permutations were placed in a coaxial test fixture and full 2-port S-parameter measurements were performed. This data produced four equations (real and imaginary part of S11 and S21) which were then used to solve for the four unknowns of interest (real and imaginary part of both permeability and permittivity). Permittivity generally had a real part of approximately 10 with very little loss in almost all cases. Permeability however varied greatly from sample to sample with the best results coming in for Block 4. FIG. 14 shows the measured permeability versus frequency for both the AC and AX sample from Block 4. These results show peak transverse permeability of 34 with low loss until roughly 500 MHz, which is slightly better than that observed in Smit and Wijn. Also, from these measurements we can calculate that the normal permeability is 0.88, which is good for the AMC application (lower normal permeability is better as will be described in subsequent sections).

The test results for all 8 blocks are summarized in Table 1 and showed good uniformity in each block tested. The most aggressive calcine cycle of 2260 F, for 3 hour soak with the highest aligning field (6000 Gauss) in combination with a 72 RPM die rotation produced the best results. Also, as anticipated, the magnetic permeability values showed direct correlation with ceramic density. $Co_2Z$ permutation #4 was therefore chosen as the baseline material for use in our magnetically loaded AMC-antenna demonstration, which, again, is described later in this report.

TABLE 1

Results for $Co_2Z$ Permutations

| Block I.D. | Density | Porosity* | Aligning Field | μ' 600 MHz | Calcination Process |
|---|---|---|---|---|---|
| 1 | 5.0 g/cc | 6% | 6000 Gauss | 26 | 2260° F.-, 1 HR |
| 2 | 4.97 | 8.10% | 6000 on/off | 21 | 2260° F.-, 1 HR |
| 3 | 4.88 | 8.80% | 1000 Gauss | 15 | 900° C. Anneal |
| 4 | 5.18 | 3.20% | 6000 Gauss | 34 | 2260° F.-3 HR |

TABLE 1-continued

Results for $Co_2Z$ Permutations

| Block I.D. | Density | Porosity* | Aligning Field | μ' 600 MHz | Calcination Process |
|---|---|---|---|---|---|
| 5 | 5.08 | 5.00% | 1000 Gauss | 26 | 2260° F.-3 HR |
| 6 | 4.9 | 8.40% | 6000 on/off | 16 | 900° C. Anneal |
| 7 | 4.89 | 8.60% | 1000 Gauss | 17 | 2260° F.-, 1 HR |
| 8 | 5.15 | 3.70% | 6000 on/off | 28 | 2260° F.-3 HR |

*Based On X-Ray Limiting Density Of 5.3 g/cm$^3$

The magnetically loaded AMC geometry differs significantly from that of the standard thumbtack structure AMC, as illustrated in FIG. 1. The magnetic materials in the magnetically loaded AMC 600 of FIG. 6 introduce effects on normal field components that overwhelm those responsible for the surface wave bandgap in the standard thumbtack structure. In order to compensate for these effects, various additional constraints are applied to the magnetic material placed in the spacer layer. First, the ferrite material 620 is 2-axis aligned. This is done to obtain maximum transverse permeability and minimum normal permeability. Second, the ferrite material 620 must be tiled. This is to move the magnetic loss characteristic up in frequency, at the expense of initial permeability, to minimize losses over the band of interest. Third, the ferrite material 620 is separated from the thumbtack FSS 602 with a dielectric material 604. This is done to maintain depressed normal permeability in the FSS layer, and thus maintain the TE bandgap. Fourth, the ferrite material 620 is cut into thin sheets 630, 632 which are metallized. This again is done to limit transverse permittivity and further minimize the normal component of permeability. Fifth, the periodicity of the ferrite vias 634 and the periodicity of the FSS patch vias 608 are selected to maintain the TM surface wave bandgap, which in general, means they will be different for this structure. All of these effects are incorporated into a design tool, which, for a specific design case, yields the geometry shown below in FIGS. 6 and 7.

The complexity of the design was necessary to achieve a surface wave bandgap over the entire high-impedance frequency band of the AMC—defined as the +/−90° reflection phase band. Certain specific aspects of the design are chosen to minimize loss and obtain the proper high impedance band, while others are primarily associated with TM surface wave cutoff, and still others principally affect the TE surface wave cutoff.

The TM surface wave cutoff is determined by the via spacing in the upper and lower spacer layer regions. For the upper spacer layer region 622 containing the Rohacell foam or other dielectric material, the vias 608 are placed at the center of every third FSS unit cell in the design example. However, in the lower region 620 containing the ferrite tiles 628, a much closer via spacing is required because of the high transverse permittivity and permeability, resulting in vias 634 placed at the center of each ferrite tile 628. In the final design, the vias are spaced 9 times closer together in the ferrite tile region 620 than in the Rohacell region 622.

The high permeability of the $CO_2Z$ perturbs the magnetic field components of the TE surface wave near the capacitive FSS layer and encourages energy to become bound to the surface. To counteract this effect, the magnetic material 620 should be as far as possible from the FSS layer 602, and its normal permeability should be minimized.

The magnetically loaded AMC design was validated with Microstripes, a commercially available full-wave simulation code. A simple effective medium model was first used in Microstripes to quickly assess the performance of the magnetically loaded AMC. The material properties of the ferrite layer used in the simulation were $\epsilon_r$=25 and μ=13.7, and a relative dielectric constant of $\epsilon_r$=1.07 was used for the foam spacer layer. The effective medium simulation predicted similar performance to the design goal so a full simulation of the complex AMC structure was performed.

Figure 8:
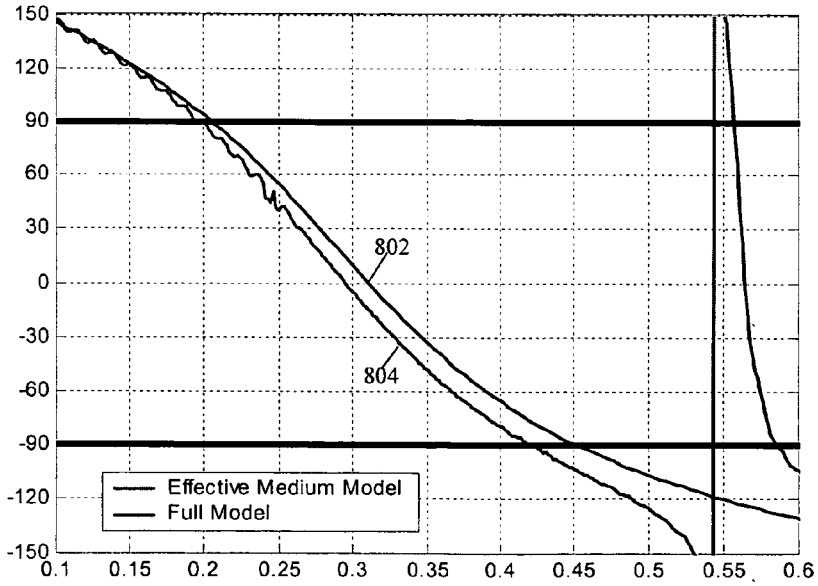
FIG. 8 illustrates simulated reflection phase for the magnetically loaded artificial magnetic conductor of FIG. 6.

The results of both simulations are shown in FIG. 8. The results of the effective medium model simulation are shown as reference numeral 802. The results of the full simulation are shown as reference numeral 804. The effective medium model simulation predicted a +/−90° reflection phase bandwidth of 205-405 MHz compared to 200-419 MHz for the full model. The full model simulation successfully verified the design and the accuracy of the effective medium model.

Figure 9:
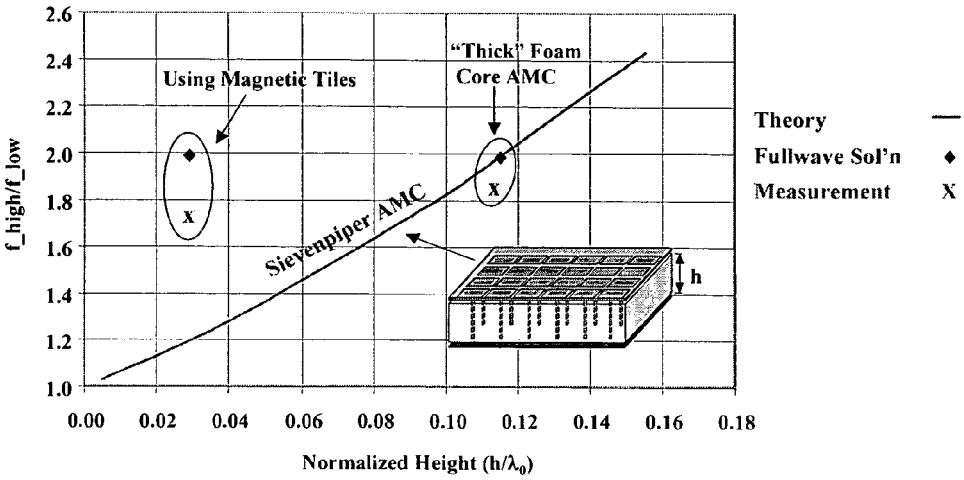
FIG. 9 illustrates bandwidth vs. thickness for theoretical, simulated and measured AMC structures.

These results are achieved in an AMC structure having approximately a one-inch thickness, which is approximately one fortieth of a free space wavelength ($\lambda_0/40$) at the center of the band. This represents almost a 5-fold decrease in thickness required to achieve this bandwidth versus the non-magnetically loaded case. This is shown in FIG. 9, which illustrates bandwidth vs. thickness for theoretical, simulated and measured AMC structures. The theoretical calculation is performed using a conventional AMC of the type described above in conjunction with FIG. 1 and illustrated in the inset of FIG. 9. The thick foam core AMC is also of this conventional type of AMC and omits magnetic loading.

The geometry described above in conjunction with FIGS. 6 and 7 was fabricated and tested. Custom ferrite tiles were produced by Precise Power Corporation and were sliced, metallized and bonded together. The raw ferrite used for the magnetically loaded AMC was custom made and was provided in thick pucks of material that were 2.25 in (5.72 cm) in diameter by 0.7 in (1.78 cm) thick. The process of machining the raw ferrite into the tiles used in the magnetically loaded AMC was completed in three stages. First, the raw ferrite was sliced into 0.1685 in (0.428 cm) thick discs of material. Each disc was then metallized on one surface with silver paint. In the final stage, two discs were bonded together, cut to size, and drilled. The initial 16.2"×16.2" AMC design required 576 tiles.

Figure 10:
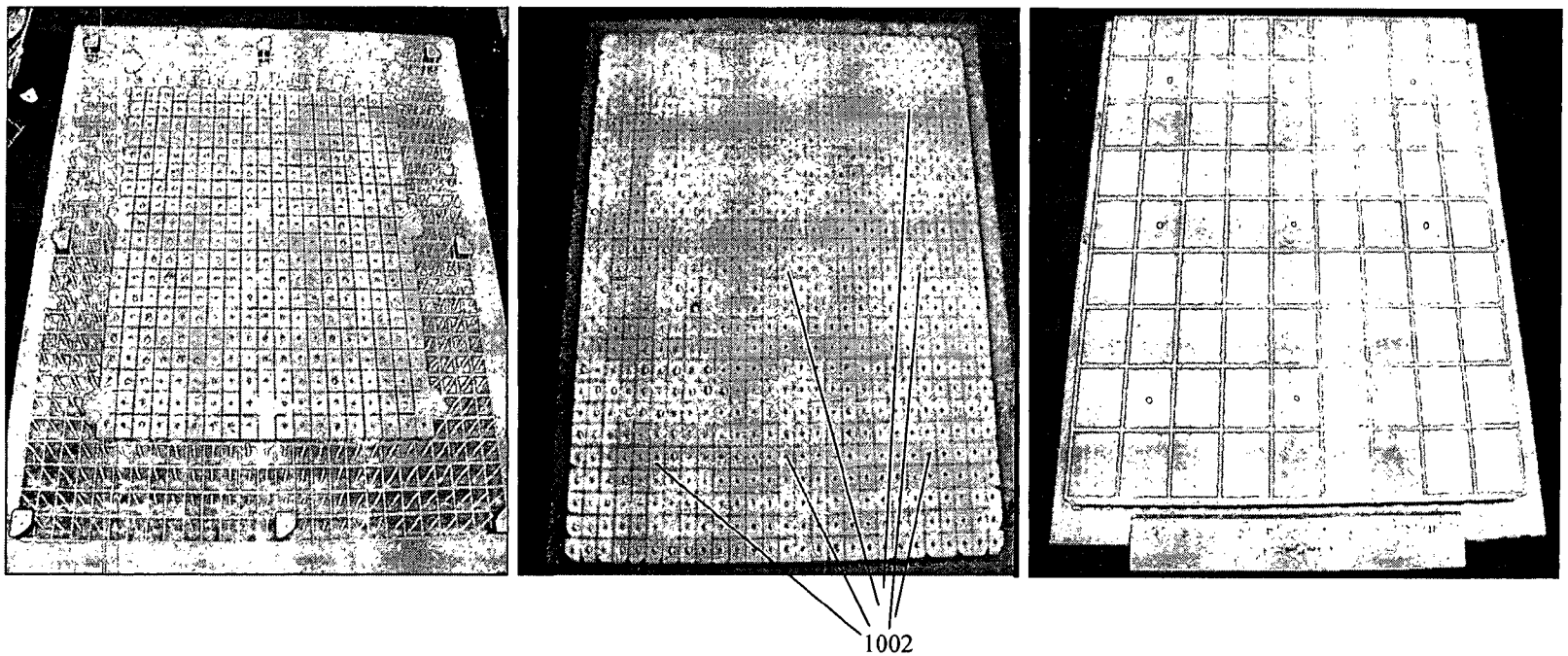
FIG. 10 is a series of photographs illustrating construction of an exemplary magnetically loaded artificial magnetic conductor.

The tiles were then placed within a guiding dielectric lattice above a metal ground plane. This is shown FIG. 10, left hand photo. FIG. 10, center photo, shows the completed ferrite portion of the AMC structure. In particular, this photo shows the nine vias 1002 which protrude above the ferrite layer for connection to the capacitive FSS patches. FIG. 10, right photo, shows the completed 16.2 in×16.2 in×1.3 in (41.15 cm×41.15 cm×2.30 cm) magnetically loaded AMC structure. The completed AMC weighed approximately 18 lbs (39.6 kg).

Figure 11:
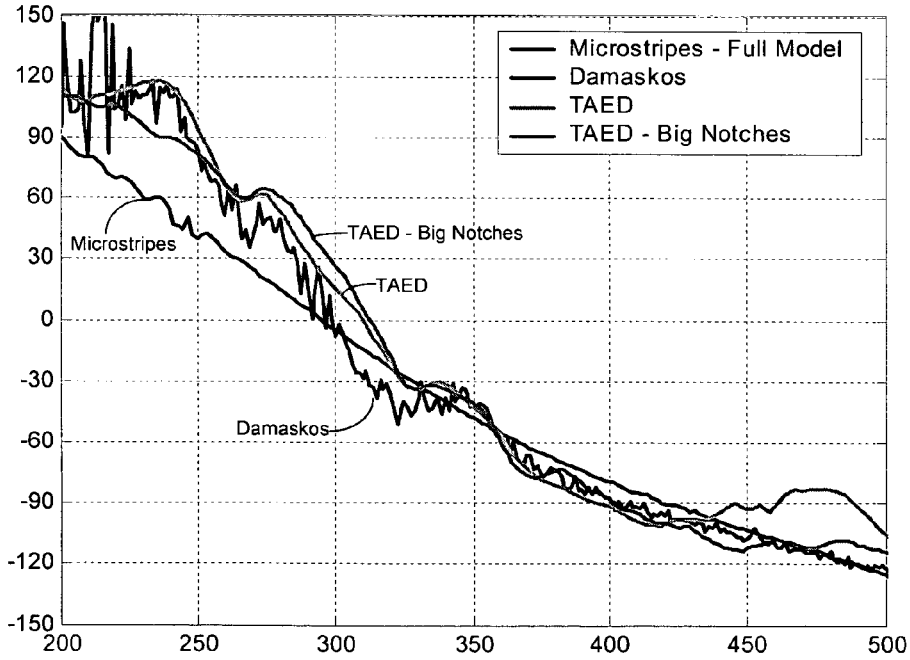
FIG. 11 illustrates measured and simulated reflection phase for the magnetically loaded artificial magnetic conductor of FIG. 10.

The reflection phase of the magnetically loaded AMC was tested at commercial test facilities. FIG. 11 illustrates measured and simulated reflection phase for the magnetically loaded artificial magnetic conductor of FIG. 10. The measurements match each other and Microstripes simulation results fairly well. Differences are attributable to edge diffraction and noise limitations given the relatively small electrical area of the AMC surface. The measured reflection phase bandwidth of the magnetically loaded AMC is 236 MHz to 402 MHz.

From the foregoing, it can be seen that the present invention provides an enhanced bandwidth AMC structure. The geometry is based upon a modification of the conventional AMC wherein the substrate is loaded with aligned, magnetic tiles. Theory predicts an aligned high-impedance and surface wave bandgap frequency band. In a demonstration article, reflection phase bandwidth was measured and agrees well with theory. It was not possible to measure the surface wave bandgap for magnetically-loaded AMC, simply because the electrical area of the unit fabricated (16.2"×16.2") was too small (was insufficient to support a true surface wave).

A magnetically loaded AMC of the type described herein features broadband performance with a substantially reduced thickness relative to the conventional AMC. A thin, broadband AMC has application as a component in an electrically-thin conformal antenna system. Such a component has many applications in fixed, mobile, and portable communications systems as well as in military applications.

While a particular embodiment of the present invention has been shown and described, modifications may be made. Accordingly, it is therefore intended in the appended claims to cover such changes and modifications which follow in the true spirit and scope of the invention.

We claim:

1. An artificial magnetic conductor (AMC) comprising:

an array of conductive patches;

a conductive ground plane; and a magnetic spacer layer including an array of magnetic tiles which comprise a barium-cobalt hexaferrite-based artificial magnetic material, the magnetic spacer layer being disposed upon the conductive ground plane and loaded with a magnetic material positioned adjacent the array of conductive patches.

2. The AMC of claim 1 further comprising conductive rods extending from at least some of the magnetic tiles and the conductive ground plane.

3. The AMC of claim 1 wherein the array of conductive patches comprises a single layer of periodically spaced patches, some or all of the patches being connected to electrical ground with conducting vias.

4. The AMC of claim 1 wherein the array of conductive patches comprises:

a first layer of conductive patches;

a second layer of conductive patches, at least some patches of the second layer overlapping at least in part patches of the first layer; and a dielectric spacer separating the first layer and the second layer.

5. The AMC of claim 1 wherein the array of conductive patches having a first periodicity and the array of magnetic tiles having a second periodicity.

6. The AMC of claim 5 wherein an integral number of magnetic tiles are positioned within a footprint of a conductive patch.

7. The AMC of claim 5 further comprising:

a first array of conductive vias between selected conductive patches and the conductive ground plane; and a second array of conductive vias between selected magnetic tiles and the conductive ground plane.

* * * * *